US008204426B2

(12) United States Patent
Shimizu

(10) Patent No.: US 8,204,426 B2
(45) Date of Patent: Jun. 19, 2012

(54) IMAGE PROCESSING FOR IMPROVING RELIABILITY OF JOB-LOCK FUNCTION

(75) Inventor: Yasushi Shimizu, Narashino (JP)

(73) Assignee: Canon Kabushiki Kaisha, Tokyo (JP)

( * ) Notice: Subject to any disclaimer, the term of this patent is extended or adjusted under 35 U.S.C. 154(b) by 800 days.

(21) Appl. No.: 12/355,752

(22) Filed: Jan. 16, 2009

(65) Prior Publication Data

US 2009/0190977 A1 Jul. 30, 2009

(30) Foreign Application Priority Data

Jan. 24, 2008 (JP) ..... 2008-014208

(51) Int. Cl.
*G03G 21/04* (2006.01)

(52) U.S. Cl. ..... 399/366; 399/42

(58) Field of Classification Search ..... 399/366, 399/42; 283/72, 73, 113, 902; *G03G 21/04; H04N 1/44*

See application file for complete search history.

(56) References Cited

U.S. PATENT DOCUMENTS

| | | | | |
|---|---|---|---|---|
| 4,723,149 | A * | 2/1988 | Harada | 399/183 |
| 5,647,010 | A * | 7/1997 | Okubo et al. | 382/100 |
| 5,798,844 | A * | 8/1998 | Sakano et al. | 358/405 |
| 2009/0153899 | A1 | 6/2009 | Shimizu | |

FOREIGN PATENT DOCUMENTS

| | | |
|---|---|---|
| JP | 07-036317 | 2/1995 |
| JP | 2006128852 | 5/2006 |
| JP | 2007281791 A * | 10/2007 |

OTHER PUBLICATIONS

Japanese Office Action dated Nov. 13, 2009 in corresponding JP Application 2008-014208.

* cited by examiner

*Primary Examiner* — Judy Nguyen
*Assistant Examiner* — Jennifer Simmons
(74) *Attorney, Agent, or Firm* — Fitzpatrick, Cella, Harper & Scinto

(57) ABSTRACT

Whether a job-lock function is enabled is determined. Whether a current mode is a mode for outputting an image of an area on an original document onto a recording paper is determined. When the job-lock function is determined to be enabled, and when the current mode is the mode for outputting the image of the part of the area of the original document on the recording paper, the image of an area larger than the part of the area is read. It is possible to improve accuracy of recognizing a copying protection pattern, and to improve security, even when density unevenness is present on a copying prevented original document.

8 Claims, 6 Drawing Sheets

IMAGE PROCESSING FOR IMPROVING RELIABILITY OF JOB-LOCK FUNCTION

BACKGROUND OF THE INVENTION

1. Field of the Invention

The present invention relates generally to an image processing, more specifically to improving reliability for security of an image processing apparatus having job-lock function.

2. Description of the Related Art

In order to prevent a special original document or a secret document from being copied by a copying machine, various apparatuses and methods have been proposed.

Starting from a method of discriminating special original documents such as bank bill and paper money from imitations thereof, in an office of a company, from a viewpoint of criticality of the content or security protection of a document, there are many documents inhibited to be copied (hereinafter, referred to as "job-locked"), even for common documents other than the special original documents. In general, on such a copying inhibited document, a mark so called "secret document mark" or "copying inhibition mark" is stamped, or a specific tint pattern is printed. By extracting the stamp mark or the tint pattern from a scanned image of the original document so as to utilize it as control information, the copying inhibited document is discriminated from documents allowed to be copied. Further, a method for inhibiting copying by burying a stamp mark of "secret document" etc. or a specific tint pattern so as to detect it, is proposed. In such a technology, since it is necessary for the copying protection pattern to be buried into an output image correctly so as to be recognized, in order to improve recognition rate or accuracy or accuracy, it is required to scan an area as large as possible.

On the other hand, in many multiple-function composite machines, since, during reading, priority is given to performance depending on the size of an original document, the size of a recording paper, or a set scaling factor, in general, they are designed so as to scan a minimum necessary area of the original document. Further, in the composite machines, there is also a function to edit an image by digital processing, represented by trimming, and even in such a case, in general, a portion of the original document, which is unnecessary for formation of the image printed on a recording paper, is not scanned.

As a prior art document of the present invention, Japanese Patent Laid Open No. H07-036317(1995) is included.

If the minimum necessary area is scanned depending on an output result, the sampling area for recognizing the above-mentioned copying protection pattern will also be narrow, thus, preventing the recognition rate or accuracy from improving.

Further, in an output device such as a printer, a phenomenon may occur, in which, due to depletion of ink, or wastage of a head or a dram, degradation of print quality such as density unevenness (hereinafter, referred to as in-plane unevenness) in an output plane occurs. For this reason, if a sampling area is not sufficiently large, since an original document that should be inhibited copying cannot be recognized, the job-lock function does not operate, resulting in high possibility of occurrence of a security hole.

SUMMARY OF THE INVENTION

The present invention provides image processing in which if a job-lock function is enabled and a current mode is a mode for outputting an image of a partial area on an original document on a recording paper, an image of an area larger than the partial area is read, hereby the above-mentioned problem can be solved.

The present invention provides an image forming apparatus that achieves the object. The apparatus comprises determination means for determining whether a job-lock function is enabled, mode determination means for determining whether a current mode is a mode for outputting an image of an area on an original document onto a recording paper, and scan means for scanning, when the determination means determines that the job-lock function is enabled and the mode determination means determines that a current mode is the mode, an image of an area larger than the area on the original document.

Alternatively, the present invention provides an image forming apparatus that achieves the object. The apparatus comprises control means for extracting control information for controlling copying from an image on an original document to take a control based on the extracted information, determination means for determining whether a mode for causing the control means to perform the control is enabled, mode determination means for determining whether a current mode is a mode for outputting an image of an area on an original document onto a recording paper, and scan means for scanning, when the determination means determines that the mode is enabled and the mode determination means determines that a current mode is the mode, an image of an area larger than the area on the original document.

The present invention provides an image forming method that achieves the object. The method comprises a step of determining whether a job-lock function is enabled, a step of determining whether a current mode is a mode for outputting an image of an area on an original document onto a recording paper; and a step of scanning, when it is determined in the job-lock determination step that the job-lock function is enabled and it is determined in the mode determination step that a current mode is the mode, an image of an area larger than the area on the original document.

Alternatively, the present invention provides an image forming method that achieves the object. The method comprises a step of extracting control information for controlling copying from an image on an original document to take a control based on the extracted information, a step of determining whether a mode for taking the control in the control step is enabled, a step of determining whether a current mode is a mode for outputting an image of an area on an original document onto a recording paper, and a step of scanning, when it is determined in the mode determination step that the mode is enabled and it is determined in the current mode determination step that a current mode is the mode, an image of an area larger than the area on the original document.

The present invention provides a computer readable medium. The medium stores a computer program for causing a computer to execute a step of determining whether a job-lock function is enabled, a step of determining whether a current mode is a mode for outputting an image of an area on an original document onto a recording paper, and a step of scanning, when it is determined in the job-lock determination step that the job-lock function is enabled and it is determined in the mode determination step that a current mode is the mode, an image of an area larger than the area on the original document.

Alternatively, the present invention provides a computer readable medium. The medium stores a computer program for causing a computer to execute a step of extracting control information for controlling copying from an image on an original document to take a control based on the extracted information, a step of determining whether a mode for taking the control in the control step is enabled, a step of determining whether a current mode is a mode for outputting an image of an area on an original document onto a recording paper, and a step of scanning, when it is determined in the mode determination step that the mode is enabled and it is determined in the current mode determination step that a current mode is the mode, an image of an area larger than the area on the original document.

Here, a specific pattern indicating inhibition of copying may be formed on the original document, and the pattern formed on the area larger than the area on the original document can be read by the read unit. Moreover, the area larger than the area on the original document may be whole area on the original document.

According to the present invention, since, the image input/output apparatus automatically operates so as to improve a recognition rate or accuracy of a job-lock pattern only when a job-lock detecting function is enabled, it is possible to improve reliability for security of the image input/output apparatus at a user unconscious level.

Further features of the present invention will become apparent from the following description of exemplary embodiments (with reference to the attached drawings).

DESCRIPTION OF THE EMBODIMENTS

Several embodiments according to the present invention will now be described in detail with reference to appended drawings.

First Embodiment

Figure 1:
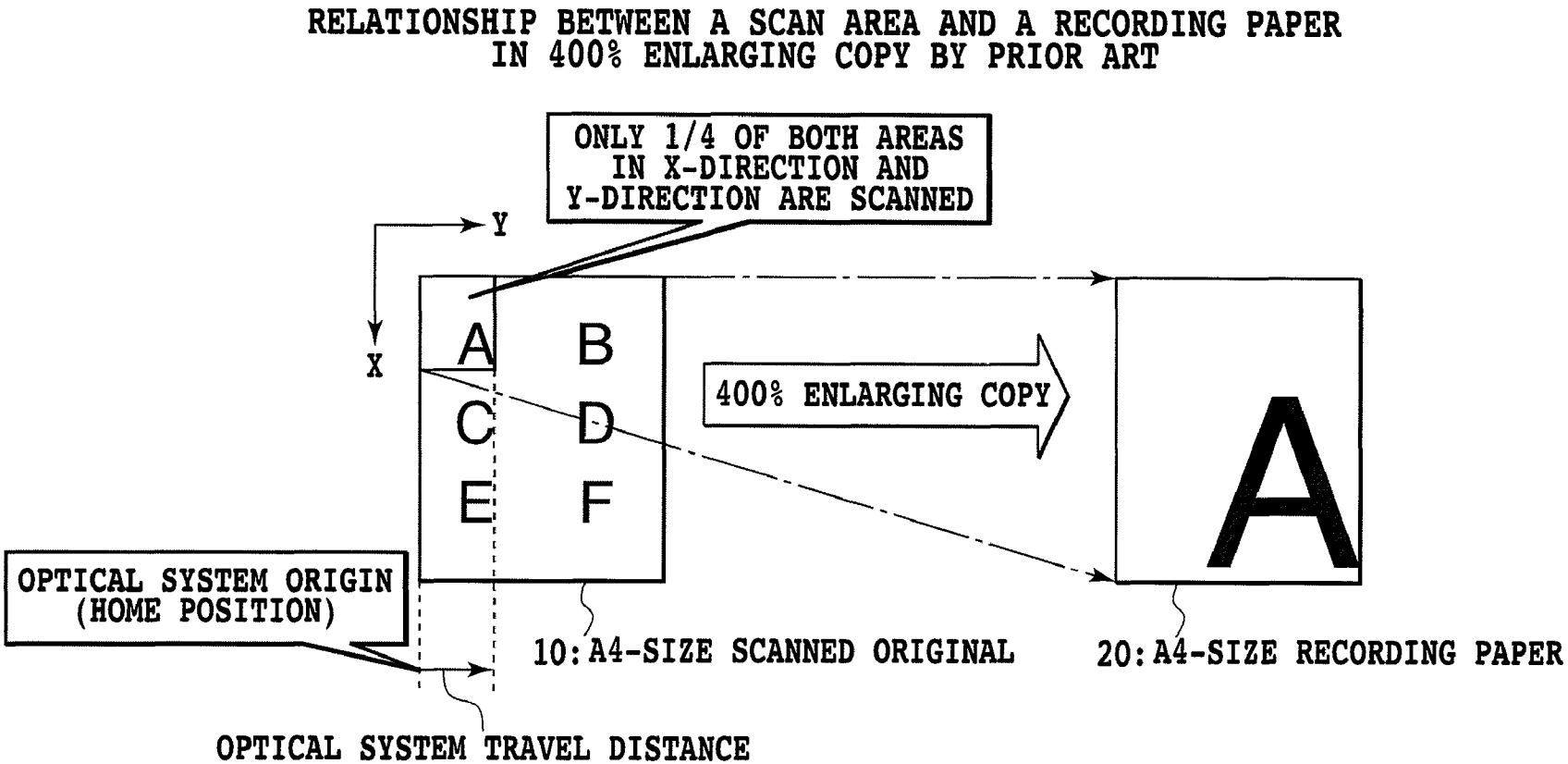
FIG. 1 is a view for describing one example of problems to be solved by the present invention.

With reference to FIG. 1, an A4 size rectangular area 10 including letters A to F indicates a scanning area on a platen, and a right side rectangular area including only the letter A indicates a recording paper. If an A4 size original document that has the same size as the scanning area, placed on the platen of a scanner, is scanned by being enlarged at scaling factor of 400%, and the enlarged scanned image is output onto an A4 size recording paper, an area that is 1/16 of the rectangular area 10 (1/4 in the x-direction and 1/4 in the y-direction) should be scanned, at a minimum.

Figure 2:
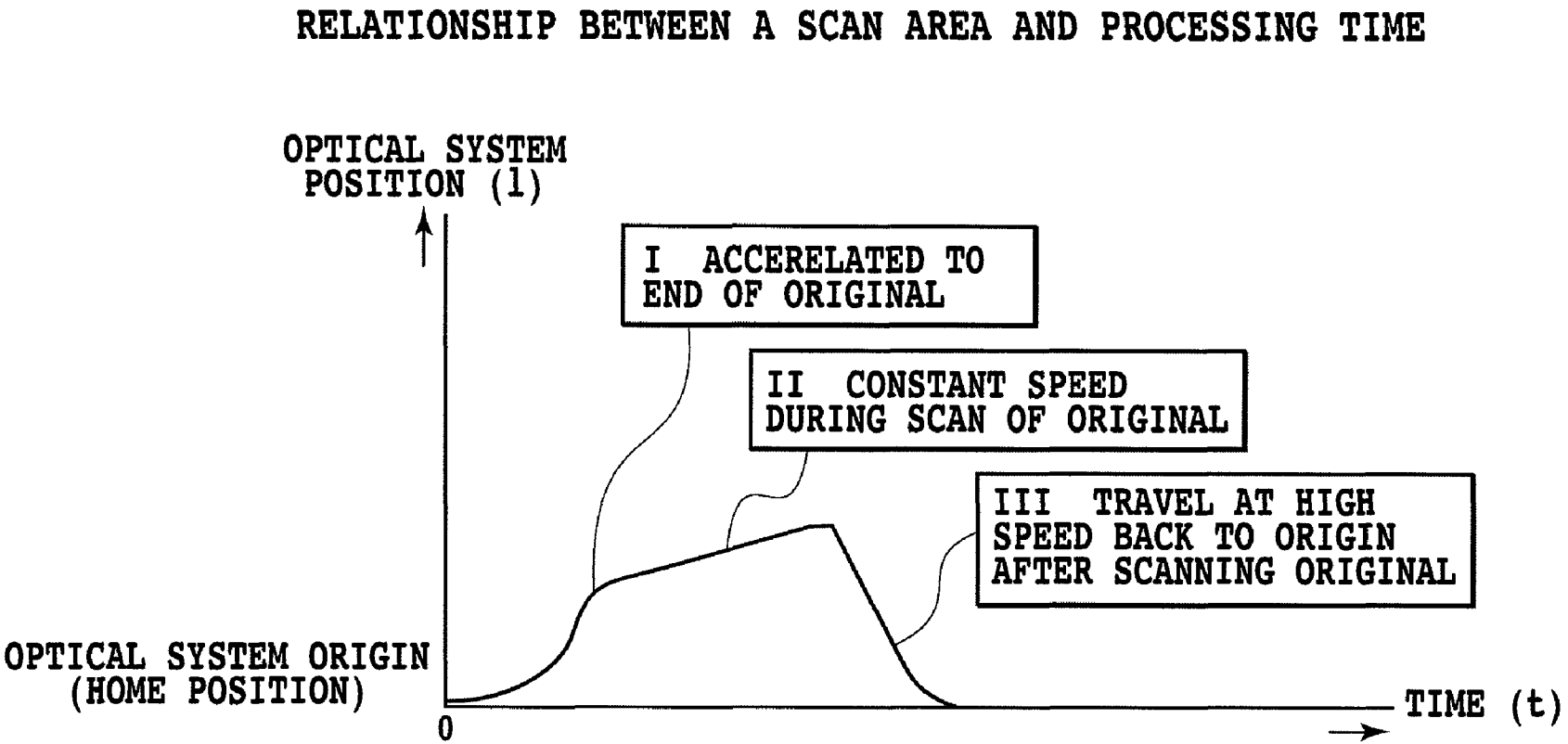
FIG. 2 is a view representing relationship between a reading area and a processing time of scanning.

FIG. 2 illustrates a relationship between reading time t (transverse direction) of an optical system and the relative position 1 (longitudinal direction) of the optical system with respect to an original document when the optical system scans the original document using an stationary original exposure type or moving original exposure type scanner equipped with a line image sensor, which is commonly used for a electrophotographic type composite machine. The stationary original exposure type scanner is a scanner for scanning an original document while fixing it and moving an optical unit by a motor, and the moving original exposure type scanner is a scanner for scanning an original document while fixing an optical unit and moving the original document. The relative position of the optical system indicates the position 1 of the optical system when the home position of the optical unit is set to zero (the position of the original document in case of the moving original exposure type scanner).

At a position i illustrated in FIG. 2 (this position corresponds to the left end of the original document), the line image sensor of the scanner (the original document in case of the moving original exposure type scanner) is accelerated in order to attain a speed for reading the original document at a uniform speed. At a position ii, the line image sensor (the original document in case of the moving original exposure type scanner) moves at the constant speed because it is within the reading section of the original document. At a position iii, since reading of the original document is completed, the line image sensor (the original document in case of the moving original exposure type scanner) moves to the inverse direction so as to return its original point (home position) at a speed higher than the constant speed.

In addition, since as the original document reading section becomes shorter, the traveling time required for the line image sensor at the position ii (traveling time at the low constant speed) becomes shorter, processing time is reduced.

Now back to FIG. 1, "an optical system traveling distance" indicates a section in which the line image sensor (or the original document) has to move at the constant speed. In case of the stationary original exposure type scanner, since the traveling time of the line image sensor to read the minimum necessary area illustrated in FIG. 1 is shorter than the traveling time to read the whole area, the scanning time is reduced.

In case of the moving original exposure type scanner, although, constitutionally, the optical system in which whole of the original document is fixed have to be moved, when the reading area is small, the constant (low) speed reading section required for reading and corresponding to the position ii can be reduced, thereby, enabling to reduce the scanning time.

Figure 3:
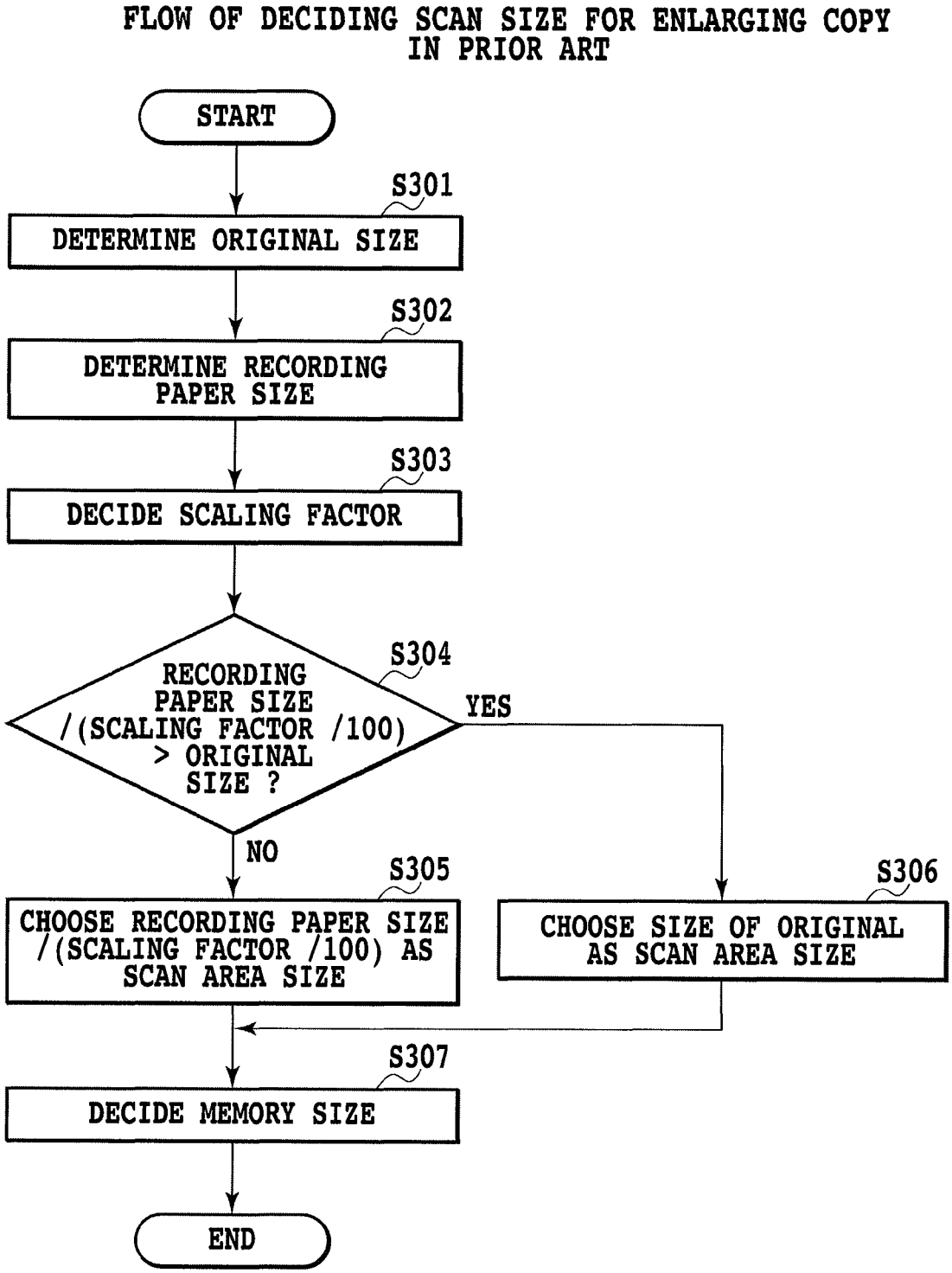
FIG. 3 is a flowchart describing a flow of prior arts.

FIG. 3 is a flowchart representing prior art of deciding the size of reading when enlarging copying is practically performed by a composite machine.

At step 301, the scanner unit determines the size of the original document.

The size of the original document is detected by a photo sensor etc. mounted on the scanner unit, or designated by a user through a console unit provided to the composite machine, before scanning. When the size of the original document is designated by a user, the designated size is enabled.

The size of the original document is defined for its longitudinal side (x-direction) and its horizontal side (y-direction), and, according to the present embodiment, it is managed by values Xo and Yo, respectively.

If the detected size of the original document is (Xd, Yd), and the size of the original document designated by a user is (Xu, Yu), when the size of the original document is designated by a user, the following relations are satisfied: Xo=Xu, and Yo=Yu, and when the size of the original document is not designated by a user, the following relations are satisfied: Xo=Xd, and Yo=Yd When A4 size is designated for the original document, the following relations are satisfied: Xo=297 mm, and Yo=210 mm.

At step 302, reading area deciding processing algorithm of the composite machine determines the size of the recording paper. The size of the recording paper is designated by a user through the console unit, or its optimum size is decided by determining a mode from the size of the original document determined at step 301 and the operation mode designated through the console unit. In some product specifications of some scanners, the size of the recording paper may also be decided after a scaling factor is decided at step 303.

At step 303, a scaling factor is decided. According to the present embodiment, a scaling factor is automatically decided from the size of the original document determined at step 301 and the size of the recording paper determined at step 302, or it is decided to a scaling factor designated through the console unit in advance. When a scaling factor is definitely designated by a user through the console unit, the designated value by the user is preferentially defined as the scaling factor.

According to the present embodiment, although, a case in which both of a scaling factor in the x-direction and a scaling factor in the y-direction are defined to 400% is exemplified, a case in which a scaling factor in the x-direction and a scaling factor in the y-direction are different from each other, may also be used.

At step 304 and the following steps, from the size of the original document, the size of the recording paper, the scaling factor which are determined or defined at steps 301 to 303, an area to be read on the original document is obtained by calculation.

For example, as illustrated in FIG. 1, a case in which both of sizes of an original document and a recording paper are A4 size, and a scaling factor is 400%, will be described. Since A4 size has a length of 297 mm in its x-direction and a length of 210 mm in its y-direction, a comparison between Xn (=297/(400/100)=74.25) and Xo (=297) in the x-direction is made, and comparison between Yn (=210/(400/100)=52.5) and Yo (=210) in the y-direction is made. Where, Xn and Yn are the size in the x-direction and the size in the y-direction on an original document of an image output onto the recording paper, respectively.

At step 304, if Xn>Xo is not satisfied, the processing advances to step 305, and Xn is chosen as a reading area (scanning area) in the x-direction. Since, in this case, the scaling is enlarging processing, the reading area in the x-direction has a size in the x-direction of the image on the original document output onto the recording paper, and not a whole area on the original document is read. On the contrary, at step 304, if Xn>Xo is satisfied, the processing advances to step 306, and Xo is chosen as the reading area (scanning area) in the x-direction. Since, in this case, the scaling is the same scaling or shrinking processing, the reading area in the x-direction is set to Xo, and the whole area on the original document is scanned. With respect to the y-direction, a reading area in the y-direction is decided by the same manner as in the x-direction.

If the dimension of the reading area is decided, at step 307, a memory capacity required from the size of the reading area is decided, and the processing is completed. In order to decide the memory capacity, although factors such as resolution and reading gradient of the scanner, and a factor such as a compressing method an image are required, description of those factors is eliminated because those do not directly relate to the present invention. In general, if a reading area is small, on a premise that a resolution and a gradient of a scanner do not change, an image can be scanned by a small memory capacity not depending on compression and non-compression of an image, and a compressing method.

In a prior art, as described in FIG. 3, from the relationship between the scaling factor and the size of the recording paper, the reading area has been decided such that the area is as small as possible. In the method of prior art of deciding the reading area in FIG. 3, when the processing advances to step 305 from the result of determination at step 304, if the scaling is enlarging, not the whole area on the original document is read. Thus, there have been problems as will now be described specifically with reference to FIG. 4.

Figure 4:
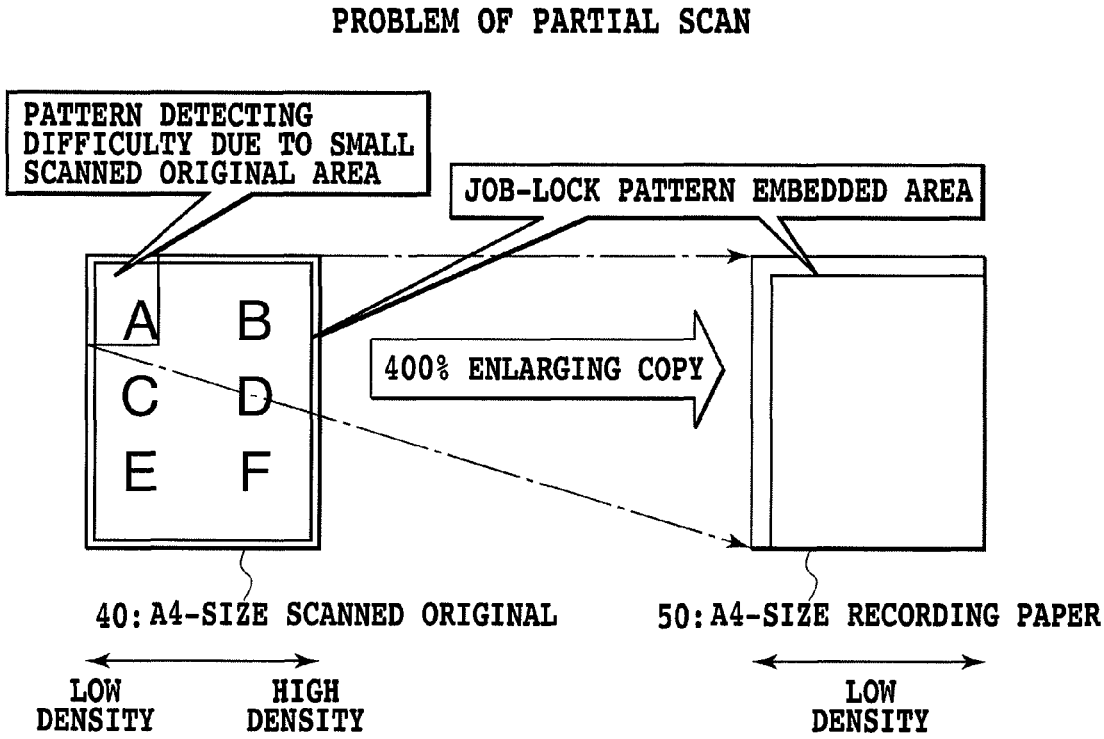
FIG. 4 is a view for describing another example of the problems to be solved by the present invention.

In the reading area deciding process of the prior art described in FIG. 3, as illustrated in FIG. 4, a copying protection pattern cannot be read correctly in relation to print quality, thereby, in some cases, the job-lock function may not operate when necessary.

In FIG. 4, a case in which, during a print of a recording paper, a density in a left side of an A4 size scanned original document 40 becomes extremely thin due to a factor such as wastage of a drum or depletion of toner, is exemplified. In such a case, if a right side area on the original document is scanned, sample data having density sufficient to determine copying protection can be obtained. However, in a case in which the original document is read by being enlarged, in the processing of the prior art of deciding the reading area described by the flowchart in FIG. 3, if scaling factor is set to 400%, only the left side area of the original document that is a minimum required area for printing, will be read. Thus, in some cases, sample data having density sufficient to determine copying protection may not be obtained, disabling to sample a copying protection pattern correctly.

According to the present invention, processing for avoiding the problems of the processing of prior arts described in FIGS. 1 to 4. Hereinafter, with reference to FIGS. 5 and 6, a first embodiment of the present invention will be described specifically.

Figure 5:
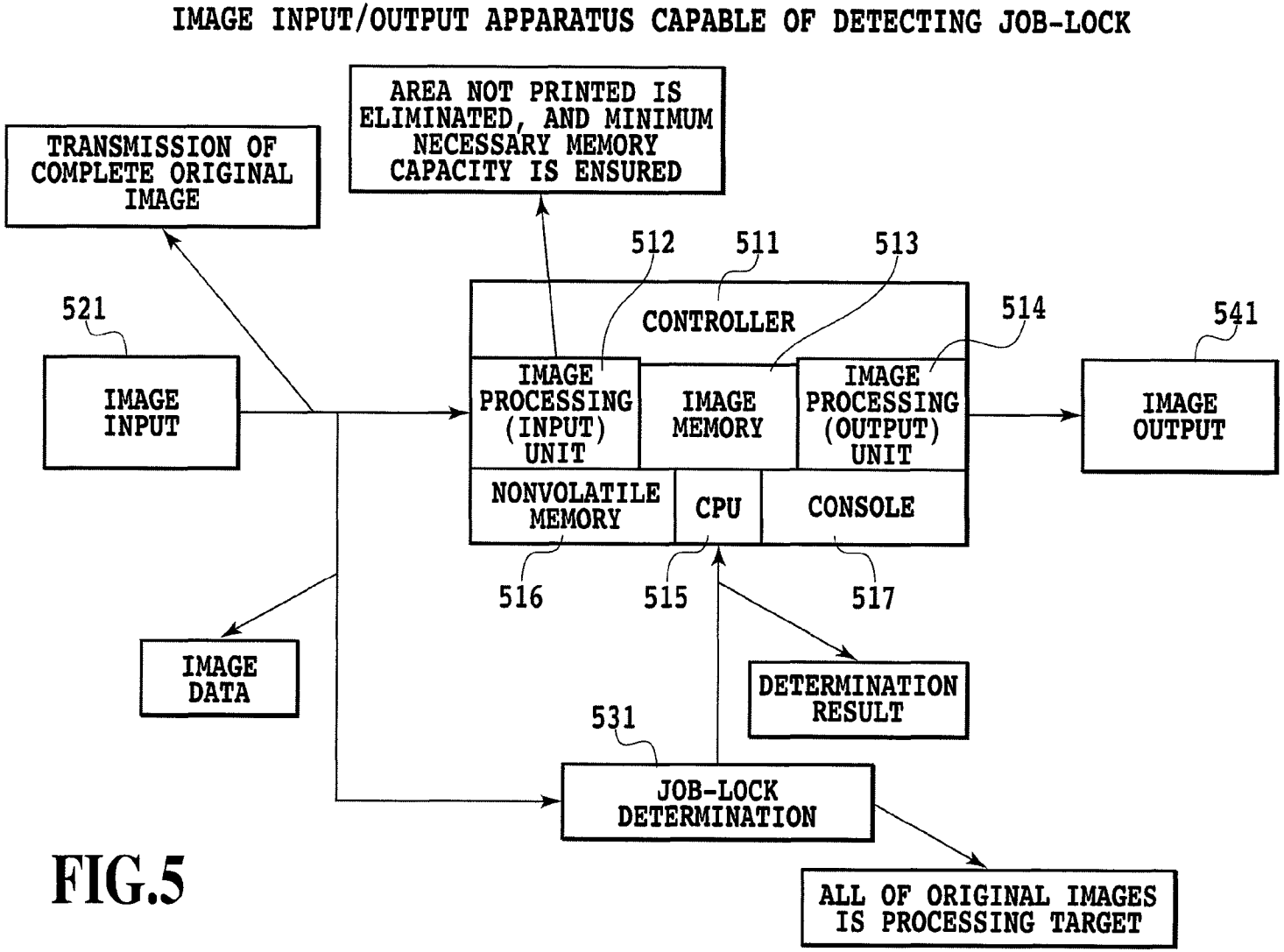
FIG. 5 is a block diagram of a job-lock detectable image input/output apparatus according to embodiments of the present invention.

FIG. 5 illustrates a block diagram of an image input/output apparatus according to the present invention, capable of detecting a job-lock pattern, and a flow of an image.

In FIG. 5, an image processing controller 511 at the center executes controlling of the whole of the apparatus and image processing. The image processing controller 511 is constituted of an image processing (inputting) unit 512, an image memory 513, an image processing (outputting) unit 514, a central processing unit (CPU) 515, a nonvolatile memory 516, and a console unit 517.

The image processing (inputting) unit 512 can execute image processing such as scaling processing at a time of inputting an image, density adjusting by means of LUT (look-up table) transformation, or edge enhancing processing. The image memory 513 temporarily stores information of a read image and information necessary for CPU 515's operation. The image processing (outputting) unit 514 can execute processing such as smoothing at a time of outputting an image. The CPU 515 controls the whole of the apparatus. The nonvolatile memory 516 can store information without deleting it even when a power of the apparatus is turned off.

An image input device 521 at a left side in FIG. 5, reads an original document using a line image sensor such as a CCD. The image input device 521 can read an original document using both or one of a stationary original exposure type scanner and a moving original exposure type scanner. A scanned original document is output to the image processing controller 511 and a job-lock determination circuit 531 described below as a digital signal. Moreover, a reading area of the scanner is decided and designated by instructions of the CPU 515 in the image processing controller 511.

The job-lock determination circuit 531 at a lower side in FIG. 5, based on the digital signal for image processing input from the image input device 521, determines whether a job-lock pattern of an image is included in the read image. The result of determination can be notified to the image processing controller 511 of the CPU 515.

An image output device 541 at a right side in FIG. 5, can output an image output from the image processing controller 511 outside the apparatus. An example of the image output device is a printing-out device, a network transmission device, or a document storage device such as a large capacity hard disk.

Figure 6:
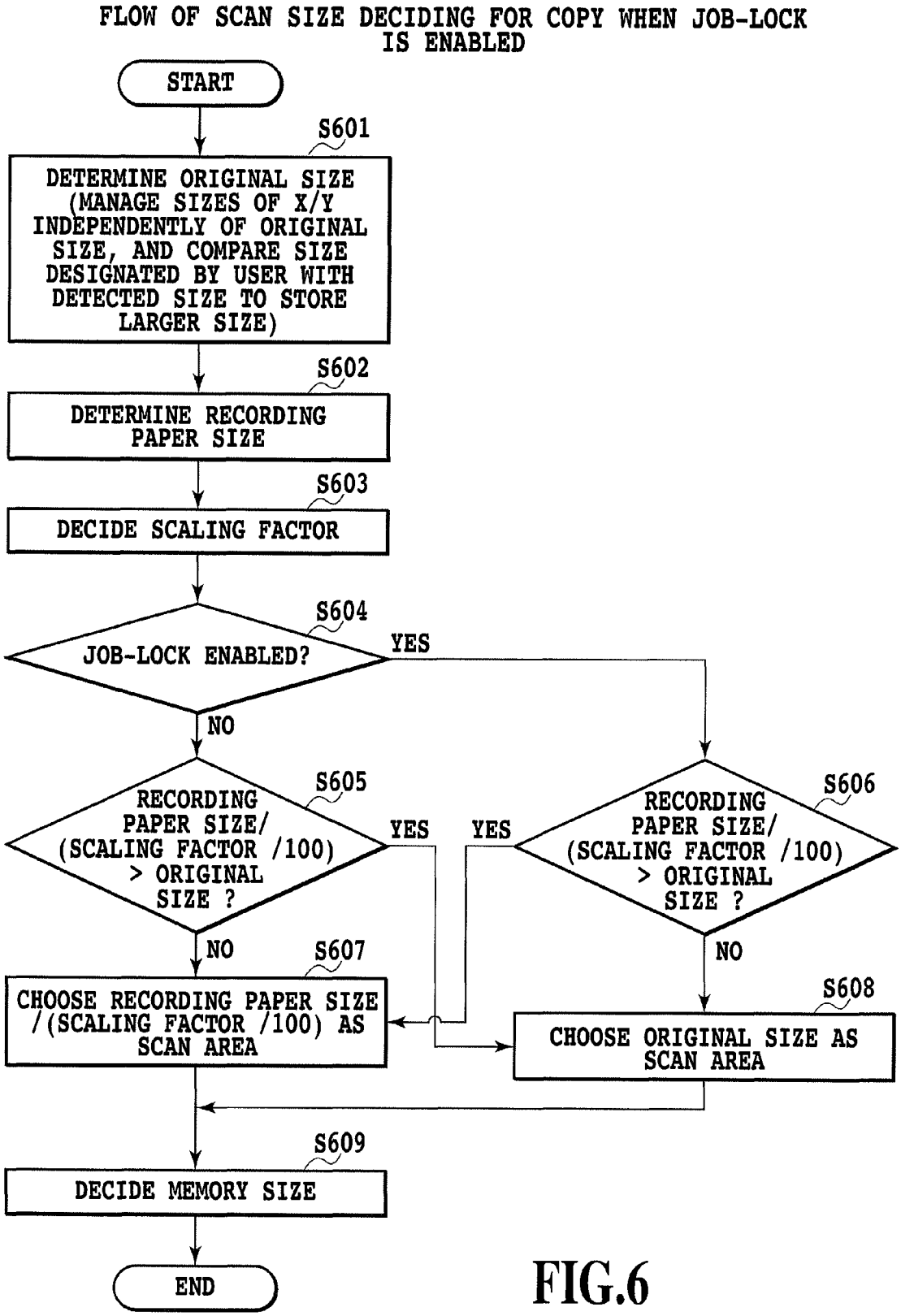
FIG. 6 is a flowchart specifically describing the processing according to a first embodiment of the present invention.

FIG. 6 illustrates a flowchart of specific processing for deciding a reading area of an original document, for solving the above mentioned problems originating from prior arts processing.

At step 601, first, in the same manner as at step 301, a size of an original document is determined. The size of the original document is determined by the CPU 515 from a detection result by a photo sensor provided to the image input device 521, or is designated by a user through the console unit 517.

When the size of the original document is designated by a user, the CPU 515 makes a comparison between the size of the original document detected by the image input device 521 and the size of the original document designated by a user, with respect to their x-direction sizes and their y-direction sizes. Then, a larger size of the x-direction sizes and a larger size of the y-direction sizes are stored in the image memory 513, respectively, as sizes Xo and Yo of the original document for determining a reading area.

When the detected size of the original document is (Xd, Yd) and the size of the original document designated by a user is (Xu, Yu), the following relations are satisfied:

if $Xd>Xu$, then, $Xo=Xd$, and if $Xd<Xu$, then, $Xo=Xu$, and if $Yd>Yu$, then, $Yo=Yd$, and if $Yd<Yu$, then, $Yo=Yu$ At step 602, in the same manner as at step 302, the CPU 515 determines a size of a recording paper. At step 603, in the same manner as at step 303, the CPU 515 decides a scaling factor.

At step 604, the CPU 515 determines whether the job-lock function is enabled.

The job-lock function is enabled in the composite machine by a manager level user of the apparatus, or a service man through a user I/F such as a console device, thereby, the setting is hardly changed. A setting of the job-lock function, is usually stored in the nonvolatile memory 516 in advance, thereby, the setting is not changed by an operation such as OFF/ON of a power source. At step 604, the CPU515 confirms the set information and determines whether the job-lock function is enabled.

When the job-lock function is disabled, the CPU515 executes processing of step 605 and following steps, then executes processing the same as the method of deciding a reading area by prior arts. Processes at steps 605, 607, 608, and 609 are the same as the processes at steps 304, 305, 306, and 307, respectively.

That is, at step 605, the CPU 515 executes an operation comparison based on the determined size of the original document, the determined size of the recording paper and the decided scaling factor. According to a comparison result, the processing is advanced to step 607 or step 608, and subsequently, at step 609 a memory size the is decided.

At step 607, the CPU 515 chooses a area of (Xn, Yn) as a reading area, (where, Xn and Yn are sizes in the-x direction and in the-y direction of an image output onto the recording paper, respectively), and not a whole area on the original document is scanned according to the scaling factor. That is, at step 605, the CPU 515 executes negative determination when the scaling processing is enlarging processing, and when a dimension of an area required for an image formed on the recording paper (the size of the recording paper/(scaling factor/100)) is smaller than the size of the original document. Since, in this case, if the whole area of the original document is scanned, an area not necessary for forming the image on the recording paper will also be scanned, the processing is advanced to step 607, and at step 607, the size of the recording paper/(scaling factor/100) is decides as the reading area so as not to scan the area not necessary for forming the image.

On the contrary, at step 605, the CPU 515 executes affirmative determination when the scaling processing is the same scaling or shrinking processing, and when a dimension of an area required for an image formed on the recording paper (the size of the recording paper/(scaling factor/100)) is larger than the size of the original document. Since, in this case, the whole area of the original document have to be scanned, the processing is advanced to step 608, and the size of the original document is decided as the reading area at step 608. Thus, processing at steps 605, 607 to 609 in which the job-lock function is disabled, is the same as in the processing of prior arts.

Now back to step 604, if the CPU 515 determines that the job-lock function is enabled, the CPU 515 advances its processing to step 606, and executes a comparing operation.

At step 606, the CPU 515, in the same manner as at step 605, calculates:

$Xn=Xo/(\text{scaling factor}/100)$, and $Yn=Yo/(\text{scaling factor}/100)$, using Xo and Yo obtained at step 601, and compares them with the size of the original document. According to a comparison result, regarding to the-x direction, if Xn>Xo, the CPU 515 advances its processing to step 607 so as to decide Xn as a reading area in the x-direction, and otherwise, the CPU 515 advances its processing to step 608 so as to decide Xo as a reading area. In the same manner, also regarding to the Y direction, if Yn>Ye, the CPU 515 advances its processing to step 607 so as to decide Yn as a reading area in the y-direction, and otherwise, the CPU 515 advances its processing to step 608 so as to decide Ye as a reading area.

At step 607 or 608, the reading area is decided so as to improve recognition accuracy of a stamp mark of such as "secret mark" or a specific tint block pattern on the original document. That is, at step 606, negative determination is given when the scaling processing is enlarging processing, and when the dimension (the size of a recording paper/(scaling factor/100)) of an area required for an image formed on the recording paper is smaller than the size of the original document. Accordingly, even if the area smaller than the size of the recording paper is scanned, an image can be formed. However, since the stamp mark or the tint pattern are also formed on an area not necessary for the image formed on the recording paper, in order to improve recognition rate or accuracy of them, the processing is advanced to step 608, the reading area is decided to be the size of the original document at step 608, which is larger than the dimension of the required area for the image.

At step 606, since, in a case of the same scaling or shrinking processing, affirmative determination is given, even if only a necessary image area is scanned, a specific pattern and the like are all contained in the area, thereby, recognition rate or accuracy will not be lowered. Thus, if affirmative determination is given at step 606, the processing is advanced to step 607 in order to save memory capacity, and the necessary image area is scanned at step 607.

At step 609, the CPU 515, based on the results of processing till step 608, as well as resolution, gradient, a compression scheme and the like, decides a memory size.

The image input device 521 executes reading of an image from the reading area decided by the CPU 515. All the read images are transmitted to the image processing controller 511 and the job-lock determination circuit 531. The image processing controller 511, using the function of the image processing (inputting) unit 512, can cut off an optimum size image depending on an output so as to input the image in the image memory 513. For this reason, it is not required for the image controller 511 to ensure an area for storing all the images of the reading area in the image memory 513.

According to the processing of the present invention, an image input/output apparatus capable of job-locking, if the job-lock function is enabled, can improve the recognition rate or accuracy of a job-lock pattern by setting an area larger than the print-out area as the reading area depending on the size of the original document and the scaling factor. Moreover, if the job-lock function is disabled, the image input/output apparatus, in the same manner as in the processing of prior arts, by reading a minimum necessary area, can scan an image without reducing the processing rate.

Second Embodiment

In the first embodiment, an example in which, when the sizes of the recording paper and the original document are different from each other in both cases in which an image is scaled or not scaled, recognition rate or accuracy of the job-lock function is improved, has been described.

In addition, there is an image input/output apparatus capable of job-locking, including a mode in which trimming and masking is designated by a user through a console unit 517, and only a part of the area of the original document is recorded. In the present embodiment, an example of processing in which, when the trimming and the masking is designated in image input/output apparatus capable of job-locking, recognition rate or accuracy of the job-lock function is improved, will be described.

When trimming and masking is designated in the image input/output apparatus capable of job-locking, it is necessary to output only the designated area on the original document into the image output device 541. For this reason, when the job-lock function is disabled, as described in the first embodiment, the CPU 515 can complete image inputting in a shortest processing time, by setting only the user designated area that is a necessary minimum area as the reading area. However, when the job-lock function is enabled, according to the present embodiment, the image processing controller 511 operates as follows even when the trimming and the masking functions are set through the console unit 517. That is, the same manner as at step 601 in FIG. 6 of the first embodiment, the controller 511 sets the larger size among the size detected by the image input device 521 and the size input by a user as the size of the original document, and always sets the area of the size of the original document as the reading area, regardless of the setting of trimming and masking. Moreover the image input device 521 reads the area of the size of the original document, and outputs the read data into the job-lock determination circuit 531 and the image processing controller 511.

At that time, the image processing controller 511 cuts out a trimming area or masks a masking area, each of which is set at the image processing (inputting) unit 512, and, further, can improve the recognition rate or accuracy of the job-lock pattern.

Third Embodiment

In the first embodiment, an example in which, when the sizes of the recording paper and the original document are different from each other in both cases in which an image is scaled or not scaled, recognition rate or accuracy of the job-lock function is improved, has been described. In the second embodiment, an example of processing in which, even when trimming and masking is set, by always setting the area of the size of the original document as the reading area, and outputting the read data into the job-lock determination circuit 531 and the image processing controller 511, recognition rate or accuracy of the job-lock function is improved, has been described.

In addition, there is an image input/output apparatus capable of job-locking, including a mode in which trimming and masking is designated by a user through a console unit 517, and only a part of the area of the original document is recorded. In the present embodiment, an example of processing in which, when trimming and masking is designated in image input/output apparatus capable of job-locking, recognition rate or accuracy of the job-lock function is improved, will be described.

There is an image input/output apparatus capable of job-locking, supporting an image repeat function. The image repeat function is a function for printing a part of or the whole area of the image of an original document on a recording paper, repeatedly, and it is realized by outputting input images repeatedly from the image processing (inputting) unit 512. When the job-lock function is disabled, the scanner may scan the repeated area. Accordingly, as described in the first embodiment, the CPU 515 can complete image inputting in a shortest processing time, by setting only the user designated area that is a necessary minimum area as the reading area.

However, when the job-lock function is enabled, according to the present embodiment, the image processing controller 511 operates as follows, even when the image repeat function is set through the console unit 517. That is, the same manner as at step 601 in FIG. 6 of the first embodiment, the controller 511 sets the larger size among the size detected by the image input device 521 and the size input by a user as the size of the original document, and always sets the area of the size of the original document as the reading area, regardless of the setting of trimming and masking. Moreover the image input device 521 reads the area of the size of the original document, and outputs the read data into the job-lock determination circuit 531 and the image processing controller 511.

At that time, the image processing controller 511, realizes the image repeat function set at the image processing (inputting) unit 512, and, further, can improve the recognition rate or accuracy of the job-lock pattern.

Other Embodiments

As described above, the present invention may be applied to a system constituted by a plurality of devices (such as a host computer, an interface device, a reader, and a printer), or may be applied to an apparatus composed of one device (such as a copying machine, or a facsimile machine).

Moreover, an embodiment in which, in order to achieve the function of the above-mentioned embodiments, a program code of software for achieving the function of the embodiments is supplied to a computer (CPU or MPU) in an apparatus or a system, connected to various devices so as to operate them, and, according to the program stored in the computer in the apparatus or the system, the various devices are operated, is also included the scope of the present invention.

Moreover, in this case, the software program code itself of the software would realize the function of the above-mentioned embodiments, thereby, the program code itself and means for supplying the program to the computer, for example, a storage medium storing such a program code in a computer readable manner, constitute the present invention.

As an example of the storage medium storing such a program code, recording media such as a floppy (registered trademark) disk, a hard disk, an optical disk, a magneto-optical disk, a CD-ROM, a magnetic tape, a nonvolatile memory card, and a ROM, may be used.

Moreover, not only a case in which a computer executes a program code supplied to itself so as to realize the function of the embodiments, but also a case in which the program code cooperates with an OS (operating system) or another application software operating on the computer so as to realize the function of the embodiments, it is obvious that such a program code is also included in embodiments of the present invention.

Further, a case in which after the supplied program code is stored on a memory provided to a function enhancement board of the computer, or a function enhancement unit connected to the computer, based on the indication of the program code, a CPU etc. provided to the function enhancement board or the function enhancement unit executes a part or the whole of the practical processing so as to realize the function of the above mentioned embodiments, is also obviously included in embodiments of the present invention.

While the present invention has been discussed with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-014208 filed Jan. 24, 2008, which is hereby incorporated by reference herein in its entirety.

What is claimed is:

1. An image forming apparatus comprising an image reading unit that reads an image, the image forming apparatus comprising:

a setting unit constructed to compare a designated size of an original document designated by a user with a detected size of the original document detected by an original document size detecting unit, so as to set a set size of the original document to the larger of the designated size and the detected size for determining an area to be read by the image reading unit;

a scaling factor deciding unit constructed to decide a scaling factor of an output image to be output onto recording paper based on the set size of the original document and the size of the recording paper for use in outputting the image read by the image reading unit;

a determining unit constructed to determine whether a job-lock function is set to be exercisable or unexercisable; and a scan area deciding unit constructed to decide an area to be scanned on the original document to be read by the image reading unit based on the decision result by the scaling factor deciding unit and the determination result by the determining unit, wherein the scan area deciding unit decides an area on the original document required for outputting the output image onto the recording paper as the area to be scanned when it is determined that the job-lock function is unexercisable and it is decided that the scaling factor of the output image is a scaling factor in an enlargement direction, the scan area deciding unit decides the entire area of the original document as the area to be scanned when it is determined that the job-lock function is unexercisable and it is decided that the scaling factor of the output image is a scaling factor other than the scaling factor in the enlargement direction, the scan area deciding unit decides an area wider than the entire area of the original document as the area to be scanned when it is determined that the job-lock function is exercisable and it is decided that the scaling factor of the output image is the scaling factor other than the scaling factor in the enlargement direction, the scan area deciding unit decides the entire area of the original document as the area to be scanned when it is determined that the job-lock function is exercisable and it is decided that the scaling factor of the output image is the scaling factor in the enlargement direction, and the image reading unit scans an image at the area to be scanned decided by the scan area deciding unit.

2. The image-forming apparatus according to claim 1, wherein a specific pattern indicating inhibition of copying is formed on the original document, and the pattern formed at the entire area is read by the reading unit.

3. An image forming apparatus comprising an image reading unit that reads an image, the image forming apparatus comprising:

a setting unit constructed to compare a designated size of an original document designated by a user with a detected size of the original document detected by an original document size detecting unit, so as to set a set size of the original document to the larger of the designated size and the detected size for determining an area to be read by the image reading unit;

a scaling factor deciding unit constructed to decide a scaling factor of an output image to be output onto recording paper based on the set size of the original document and the size of the recording paper for use in outputting the image read by the image reading unit;

a determining unit constructed to determine whether a job-lock function for causing control unit to extract control information for controlling copying of an image on the original document to then perform control based on the extracted control information is set to be exercisable or unexercisable; and a scan area deciding unit constructed to decide an area to be scanned on the original document to be read by the image reading unit based on the decision result by the scaling factor deciding unit and the determination result by the determining unit, wherein the scan area deciding unit decides an area on the original document required for outputting the output image onto the recording paper as the area to be scanned when it is determined that the job-lock function is unexercisable and it is decided that the scaling factor of the output image is a scaling factor in an enlargement direction, the scan area deciding unit decides the entire area of the original document as the area to be scanned when it is determined that the job-lock function is unexercisable and it is decided that the scaling factor of the output image is a scaling factor other than the scaling factor in the enlargement direction, the scan area deciding unit decides an area wider than the entire area of the original document as the area to be scanned when it is determined that the job-lock function is exercisable and it is decided that the scaling factor of the output image is the scaling factor other than the scaling factor in the enlargement direction, the scan area deciding unit decides the entire area of the original document as the area to be scanned when it is determined that the job-lock function is exercisable and it is decided that the scaling factor of the output image is the scaling factor in the enlargement direction, and the control unit performs the control based on the control information in accordance with an image which is scanned by the image reading unit, at the area to be scanned decided by the scan area deciding unit.

4. An image forming method for processing an image read by an image reading unit, the image forming method comprising the steps of:

comparing a designated size of an original document designated by a user with a detected size of the original document detected by an original document size detecting unit, so as to set a set size of the original document to the larger of the designated size and the detected size for determining an area to be read by the image reading unit;

deciding a scaling factor of an output image to be output onto recording paper based on the set size of the original document and the size of the recording paper for use in outputting the image read by the image reading unit;

determining whether a job-lock function is set to be exercisable or unexercisable;

deciding an area to be scanned on the original document to be read by the image reading unit based on the decision result in the scaling factor deciding step and the determination result of the determining step, wherein the scan area deciding step includes the steps of:

deciding an area on the original document required for outputting the output image onto the recording paper as the area to be scanned when it is determined that the job-lock function is unexercisable and it is decided that the scaling factor of the output image is a scaling factor in an enlargement direction, deciding the entire area of the original document as the area to be scanned when it is determined that the job-lock function is unexercisable and it is decided that the scaling factor of the output image is a scaling factor other than the scaling factor in the enlargement direction, deciding an area wider than the entire area of the original document as the area to be scanned when it is determined that the job-lock function is exercisable and it is decided that the scaling factor of the output image is the scaling factor other than the scaling factor in the enlargement direction, and deciding the entire area of the original document as the area to be scanned when it is determined that the job-lock function is exercisable and it is decided that the scaling factor of the output image is the scaling factor in the enlargement direction; and scanning, by the image reading unit, an image at the area to be scanned decided in the scan area deciding step.

5. The image-forming method according to claim 4, wherein a specific pattern indicating inhibition of copying is formed on the original document, and the pattern formed at the entire area is read in the reading step.

6. An image forming method comprising the steps of:

comparing a designated size of an original document designated by a user with a detected size of an original document detected by an original document size detecting unit, so as to set a set size of the original document to the larger of the designated size and the detected size for determining an area to be read by the image reading unit;

deciding a scaling factor of an output image to be output onto recording paper based on the set size of the original document and the size of the recording paper for use in outputting the image read by the image reading unit;

determining whether a job-lock function for causing control unit to extract control information for controlling copying of an image on the original document to then perform control based on the extracted control information is set to be exercisable or unexercisable;

deciding an area to be scanned on the original document to be read by the image reading unit based on the decision result in the scaling factor deciding step and the determination result by the determining step, wherein the scan area deciding step includes the steps of:

deciding an area on the original document required for outputting the output image onto the recording paper as the area to be scanned when it is determined that the job-lock function is unexercisable and it is decided that the scaling factor of the output image is a scaling factor in an enlargement direction, deciding the entire area of the original document as the area to be scanned when it is determined that the job-lock function is unexercisable and it is decided that the scaling factor of the output image is a scaling factor other than the scaling factor in the enlargement direction, deciding an area wider than the entire area of the original document as the area to be scanned when it is determined that the job-lock function is exercisable and it is decided that the scaling factor of the output image is the scaling factor other than the scaling factor in the enlargement direction, and deciding the entire area of the original document as the area to be scanned when it is determined that the job-lock function is exercisable and it is decided that the scaling factor of the output image is the scaling factor in the enlargement direction;

scanning, by the image reading unit, an image at the area to be scanned decided in the scan area deciding step; and performing, by the control unit, the control based on the control information in accordance with an image scanned in the scanning step.

7. A non-transitory computer-readable storage medium storing therein a computer-executable program for causing a computer to execute the steps of:

comparing a designated size of an original document designated by a user with a detected size of the original document detected by an original document size detecting unit, so as to set a set size of the original document to the larger of the designated size and the detected size for determining an area to be read by the image reading unit;

deciding a scaling factor of an output image to be output onto recording paper based on the set size of the original document and the size of the recording paper for use in outputting the image read by the image reading unit;

determining whether a job-lock function is set to be exercisable or unexercisable;

deciding an area to be scanned on the original document to be read by the image reading unit based on the decision result in the scaling factor deciding step and the determination result by the determining step, wherein the scan area deciding step includes the steps of:

deciding an area on the original document required for outputting the output image onto the recording paper as the area to be scanned when it is determined that the job-lock function is unexercisable and it is decided that the scaling factor of the output image is a scaling factor in an enlargement direction, deciding the entire area of the original document as the area to be scanned when it is determined that the job-lock function is unexercisable and it is decided that the scaling factor of the output image is a scaling factor other than the scaling factor in the enlargement direction, deciding an area wider than the entire area of the original document as the area to be scanned when it is determined that the job-lock function is exercisable and it is decided that the scaling factor of the output image is the scaling factor other than the scaling factor in the enlargement direction, and deciding the entire area of the original document as the area to be scanned when it is determined that the job-lock function is exercisable and it is decided that the scaling factor of the output image is the scaling factor in the enlargement direction; and scanning, by the image reading unit, an image at the area to be scanned decided in the scan area deciding step.

8. A non-transitory computer-readable storage medium storing therein a computer-executable program for causing a computer to execute the steps of:

comparing a designated size of an original document designated by a user with a detected size of the original document detected by an original document size detecting unit, so as to set a set size of the original document to the larger of the designated size and the detected size for determining an area to be read by the image reading unit;

deciding a scaling factor of an output image to be output onto recording paper based on the set size of the original document and the size of the recording paper for use in outputting the image read by the image reading unit;

determining whether a job-lock function for causing control unit to extract control information for controlling copying of an image on the original document to then perform control based on the extracted control information is set to be exercisable or unexercisable;

deciding an area to be scanned on the original document to be read by the image reading unit based on the decision result in the scaling factor deciding step and the determination result by the determining step, wherein the scan area deciding step includes the steps of:

deciding an area on the original document required for outputting the output image onto the recording paper as the area to be scanned when it is determined that the job-lock function is unexercisable and it is decided that the scaling factor of the output image is a scaling factor in an enlargement direction, deciding the entire area of the original document as the area to be scanned when it is determined that the job-lock function is unexercisable and it is decided that the scaling factor of the output image is a scaling factor other than the scaling factor in the enlargement direction, deciding an area wider than the entire area of the original document as the area to be scanned when it is determined that the job-lock function is exercisable and it is decided that the scaling factor of the output image is the scaling factor other than the scaling factor in the enlargement direction, and deciding the entire area of the original document as the area to be scanned when it is determined that the job-lock function is exercisable and it is decided that the scaling factor of the output image is the scaling factor in the enlargement direction;

scanning, by the image reading unit, an image at the area to be scanned decided in the scan area deciding step; and performing, by the control unit, the control based on the control information in accordance with an image scanned in the scanning step.

* * * * *